US007575514B2

(12) United States Patent
Cuddy et al.

(10) Patent No.: US 7,575,514 B2
(45) Date of Patent: Aug. 18, 2009

(54) GAMING DEVICE HAVING A MATRIX AND SYMBOL GENERATOR

(75) Inventors: Ryan W. Cuddy, Reno, NV (US); Michael MacVittie, Las Vegas, NV (US); Amy E. Ruppert, Reno, NV (US)

(73) Assignee: IGT, Reno, NV (US)

( * ) Notice: Subject to any disclaimer, the term of this patent is extended or adjusted under 35 U.S.C. 154(b) by 948 days.

(21) Appl. No.: 10/923,541

(22) Filed: Aug. 20, 2004

(65) Prior Publication Data

US 2006/0040721 A1 Feb. 23, 2006

(51) Int. Cl.
*A63F 3/00* (2006.01)

(52) U.S. Cl. ..... 463/16; 463/17; 463/18; 463/19; 463/20

(58) Field of Classification Search ..... 463/16, 463/17–19, 20, 21, 25; 273/237, 238, 265, 273/146, 138.1, 138.2, 139, 141 R, 141 A, 273/142 B, 142 C, 143 R, 143 A, 143 B
See application file for complete search history.

(56) References Cited

U.S. PATENT DOCUMENTS

| | | | |
|---|---|---|---|
| 1,527,929 | A | 2/1925 | Simons |
| 4,508,357 | A | 4/1985 | Reich |
| 4,560,161 | A | 12/1985 | Hamano |
| 4,695,053 | A | 9/1987 | Vazquez, Jr. et al. |
| 4,743,022 | A | 5/1988 | Wood |
| 5,332,228 | A | 7/1994 | Schultz |
| 5,342,047 | A | 8/1994 | Heidel et al. |
| 5,423,539 | A | 6/1995 | Nagao |
| 5,431,408 | A | 7/1995 | Adams |
| 5,449,173 | A | 9/1995 | Thomas et al. |
| 5,536,016 | A | 7/1996 | Thompson |

(Continued)

FOREIGN PATENT DOCUMENTS

EP 0 874 337 A1 10/1998

(Continued)

OTHER PUBLICATIONS

Battleship Advertisement, printed from www.mikohn.com (website) on Apr. 25, 2001.

(Continued)

*Primary Examiner*—Dmitry Suhol
*Assistant Examiner*—Damon J. Pierce
(74) *Attorney, Agent, or Firm*—K&L Gates LLP

(57) ABSTRACT

A gaming device including a plurality of elements and a plurality of element groups. Each of said elements is in at least two different element groups and the plurality of elements are associated with a plurality of outcomes, such as values. The gaming device also includes an element group generator that selects one of the element groups. Selection of an element group by the element group generator activates the elements in selected element group. In one embodiment, The element group generator may also select a multi-group activator that activates the elements in each of a plurality of element groups. The gaming device selects element groups until at least one element is activated a predetermined number of times wherein the predetermined number of times is at least two. The game provides an award to a player based on the outcome or value associated with the elements activated the predetermined number of times.

61 Claims, 17 Drawing Sheets

U.S. PATENT DOCUMENTS

| | | | |
|---|---|---|---|
| 5,772,509 | A | 6/1998 | Weiss |
| 5,788,573 | A | 8/1998 | Baerlocher et al. |
| 5,823,873 | A | 10/1998 | Moody |
| 5,823,874 | A | 10/1998 | Adams |
| 5,848,932 | A | 12/1998 | Adams |
| 5,855,514 | A | 1/1999 | Kamille |
| 5,873,781 | A | 2/1999 | Keane |
| 5,882,261 | A | 3/1999 | Adams |
| 5,902,184 | A | 5/1999 | Bennett |
| 5,911,418 | A | 6/1999 | Adams |
| 5,927,714 | A | 7/1999 | Kaplan |
| 5,938,200 | A | 8/1999 | Markowicz et al. |
| 5,947,820 | A | 9/1999 | Morro et al. |
| 5,951,397 | A | 9/1999 | Dickinson |
| 5,976,015 | A | 11/1999 | Seelig et al. |
| 5,997,400 | A | 12/1999 | Seelig et al. |
| 5,997,401 | A | 12/1999 | Crawford |
| 6,015,346 | A | 1/2000 | Bennett |
| 6,033,307 | A | 3/2000 | Vancura |
| 6,056,642 | A | 5/2000 | Bennett |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,102,798 | A | 8/2000 | Bennett |
| 6,120,031 | A | 9/2000 | Adams |
| 6,120,378 | A | 9/2000 | Moody |
| 6,126,542 | A | 10/2000 | Fier |
| 6,135,882 | A | 10/2000 | Kadlic |
| 6,135,885 | A | 10/2000 | Lermusiaux |
| 6,146,271 | A | 11/2000 | Kadlic |
| 6,149,156 | A | 11/2000 | Feola |
| 6,149,157 | A | 11/2000 | Suan |
| 6,159,095 | A | 12/2000 | Frohm et al. |
| 6,159,097 | A | 12/2000 | Gura |
| 6,159,098 | A | 12/2000 | Slomiany et al. |
| 6,162,121 | A | 12/2000 | Morro et al. |
| 6,164,652 | A | 12/2000 | Lauretta et al. |
| 6,165,070 | A | 12/2000 | Nolte et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,235 | B1 | 1/2001 | Walker et al. |
| 6,190,254 | B1 | 2/2001 | Bennett |
| 6,190,255 | B1 | 2/2001 | Thomas et al. |
| 6,203,429 | B1 | 3/2001 | Demar et al. |
| 6,224,482 | B1 | 5/2001 | Bennett |
| 6,231,442 | B1 | 5/2001 | Mayeroff |
| 6,234,897 | B1 | 5/2001 | Frohm et al. |
| 6,261,177 | B1 | 7/2001 | Bennett |
| 6,299,165 | B1 | 10/2001 | Nagano |
| 6,309,299 | B1 | 10/2001 | Weiss |
| 6,312,334 | B1 | 11/2001 | Yoseloff |
| 6,315,664 | B1 | 11/2001 | Baerlocher et al. |
| 6,319,124 | B1 | 11/2001 | Baerlocher et al. |
| 6,346,043 | B1 | 2/2002 | Colin et al. |
| 6,347,996 | B1 | 2/2002 | Gilmore et al. |
| 6,364,766 | B1 | 4/2002 | Anderson et al. |
| 6,364,767 | B1 | 4/2002 | Brossard et al. |
| 6,398,644 | B1 | 6/2002 | Perrie et al. |
| 6,406,369 | B1 | 6/2002 | Baerlocher et al. |
| 6,413,160 | B1 | 7/2002 | Vancura |
| 6,413,161 | B1 | 7/2002 | Baerlocher et al. |
| 6,425,824 | B1 | 7/2002 | Baerlocher et al. |
| 6,439,995 | B1 | 8/2002 | Hughs-Baird et al. |
| 6,443,837 | B1 | 9/2002 | Jaffe et al. |
| 6,464,582 | B1 | 10/2002 | Baerlocher et al. |
| 6,494,785 | B1 | 12/2002 | Gerrard et al. |
| 6,506,117 | B2 | 1/2003 | DeMar et al. |
| 6,514,141 | B1 | 2/2003 | Kaminkow et al. |
| 6,572,472 | B1 | 6/2003 | Glavich |
| 6,575,830 | B2 | 6/2003 | Baerlocher et al. |
| 6,585,591 | B1 | 7/2003 | Baerlocher et al. |
| 6,602,137 | B2 | 8/2003 | Kaminkow et al. |
| 6,604,740 | B1 | 8/2003 | Singer et al. |
| 6,604,974 | B2 | 8/2003 | Doty et al. |
| 6,616,142 | B2 | 9/2003 | Adams |
| 6,632,141 | B2 | 10/2003 | Webb et al. |
| 6,685,561 | B2 | 2/2004 | Anderson et al. |
| 6,688,975 | B2 | 2/2004 | Baerlocher et al. |
| 6,722,982 | B2 | 4/2004 | Kaminkow et al. |
| 6,722,983 | B2 | 4/2004 | Kaminkow et al. |
| 2002/0142821 | A1 | 10/2002 | Baerlocher |
| 2003/0060272 | A1* | 3/2003 | Glavich et al. ..... 463/25 |
| 2004/0023708 | A1 | 2/2004 | Kaminkow et al. |
| 2005/0026673 | A1 | 2/2005 | Paulsen et al. |

FOREIGN PATENT DOCUMENTS

| | | | |
|---|---|---|---|
| EP | 0 945 837 | A2 | 9/1999 |
| EP | 0 984 408 | A2 | 3/2000 |
| EP | 0 984 409 | A2 | 3/2000 |
| WO | WO 9732285 | | 9/1997 |
| WO | WO 00/12186 | | 3/2000 |
| WO | WO 00/66235 | | 11/2000 |
| WO | WO 0076606 | A1 | 12/2000 |

OTHER PUBLICATIONS

Battleship Article, written by Strictly Slots, published in 2000.
Break the Spell Article, written by Strictly Slots, published in 2000.
Break the Spell Advertisement, written by Atronic Casino Technology, published in 1999.
Enchanted Forest Advertisement, written by Aristocrat, Inc., published in 1995.
Jackpot Party Advertisements, written by WMS Gaming, Inc., published in 1998.
Piggy Banking and Big Bang Piggy Banking Advertisements, written by WMS Gaming, published prior to 2004.
Price is Right Showcase Showdown, printed from www.schuminweb.com (website) on Mar. 16, 2001.
Top Dollar Brochure, written by IGT, published in 1998.
Wheel of Fortune Advertisements, written by IGT, published in 1998, 1999 and 2002.
International Search Report on Patentability for International Application No. PCT/US05/28036 dated Mar. 10, 2009.

* cited by examiner

65

| | 62a 67a A | 62b 67b B | 62c 67c C | 62d 67d D |
|---|---|---|---|---|
| 62e E 66e | 100 64a | 50 64e | 80 64i | 10 64m |
| 62f F 66f | 15 64b | 200 64f | 50 64j | 75 64n |
| 62g G 66g | 75 64c | 35 64g | 500 64k | 60 64o |
| 62h H 66h | 45 64d | 85 64h | 15 64l | 250 64p |

65

| | 62a 67a A | 62b 67b B | 62c 67c C | 62d 67d D |
|---|---|---|---|---|
| 62e 66e E | 100 64a | 50 64e | 80 64i | 10 64m |
| 62f 66f F | 15 64b | 200 64f | 50 64j | 75 64n |
| 62g 66g G | 75 64c | 35 64g | 500 64k | 60 64o |
| 62h 66h H | 45 64d | 85 64h | 15 64l | 250 64p |

| | ELEMENT | VALUE | |
|---|---|---|---|
| 64a | A1 | 100 | 68a |
| 64b | A2 | 50 | 68b |
| 64c | A3 | 80 | 68c |
| 64d | A4 | 100 | 68d |
| 64e | B1 | 10 | 68e |
| 64f | B2 | 15 | 68f |
| 64g | B3 | 200 | 68g |
| 64h | B4 | 75 | 68h |
| 64i | C1 | 50 | 68i |
| 64j | C2 | 15 | 68j |
| 64k | C3 | 40 | 68k |
| 64l | C4 | 25 | 68l |

| | A | B | C | D |
|---|---|---|---|---|
| | | 10,000 | | |
| E | 100 | 50 | 80 | 10 |
| F | 15 | 35 | 50 | 75 |
| G | 75 | 65 | 500 | 60 |
| H | 45 | | 15 | 250 |

70

64

64

GAMING DEVICE HAVING A MATRIX AND SYMBOL GENERATOR

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device and more particularly to a gaming device having groups of elements that are activated based on an element group generator.

Gaming device manufacturers strive to make gaming devices that provide as much enjoyment and excitement as possible. Existing games provide players with values based upon symbols that a player obtains using one or more symbol generators, such as a plurality of reels. Awards are provided to the player based on the symbols or combination of symbols generated by the symbol generator.

A player may receive a relatively high bonus value for obtaining a certain symbol and a relatively low bonus value for another symbol. The value awarded for the same symbol can also vary. For instance, if a player chooses a symbol on one occasion, the game may award a certain value and if the player chooses the same symbol on another occasion, the game may award a different value. The values which are awarded to a player are predetermined by a computer using known data or by randomly generating numbers based upon one or more mathematical formulas.

Gaming devices that provide players with large awards or the potential to win large awards are especially attractive to players. Providing multiple winning symbols allows a player to obtain a total of several award values and substantially increases a player's total award. Player interest is increased when the award possibilities are more numerous and the award is based on multiple winning options. To increase player enjoyment and excitement, it is desirable to provide players with new game schemes for gaming devices which include a symbol generator and provide players with potentially large awards.

SUMMARY OF THE INVENTION

The present invention is directed to a gaming device having a game including a plurality of elements. The game includes a plurality of element groups wherein each element group includes a plurality of the elements. In one embodiment, each of the elements is in or should be at least two of the different groups. In one embodiment, the game also includes an element group generator which is adapted to generate or select one of the element groups. When the element group generator generates or selects one of the element groups, the gaming device activates each element in the selected element group. The gaming device then determines if any of the plurality of elements are activated a predetermined number of times. The predetermined number is preferably at least two. If no element is activated the predetermined number of times, the element group generator generates or selects another element group, each element of the selected element group is activated and the above-described process is repeated until at least one element is activated the predetermined number of times. If at least one element is activated the predetermined number of times, an outcome, such as an award is provided to the player and the game terminates.

In one embodiment, an outcome, such as an award or value is associated with each element. In this embodiment, the player obtains the outcome that is associated with each element that is activated the predetermined number of times. For example, if three elements are each activated the predetermined number of times, then the player will obtain the awards associated with these three elements. In another embodiment, the outcome provided to the player is based on the number of different element groups selected. In another embodiment, the outcome provided to the player is based on the number of times the element group generator selected element groups until one of the elements was activated the predetermined number of times, which is preferably at least two times.

In one embodiment of the present invention, the element groups are arranged in a grid configuration. The element groups are arranged in rows and columns, so that each element is in both a row and a column. In this embodiment, each row functions as an element group and each column functions as an element group. Therefore, since each element is in one row element group and one column element group, each element is in at least two different element groups. After initiation of the game, the element group generator generates or selects an initial group of elements from the plurality of groups of elements. The selected group of elements corresponds to a row or column of the grid. The selection of the initial group of elements causes all the elements in the corresponding row or column to be activated.

After each of the elements in the selected group of elements (displayed as each of the elements in the corresponding row or column) are activated, the gaming device determines if any of the elements are activated the predetermined number of times. The predetermined number is preferably at least two. For example, if the predetermined number is two and only the elements in the initially selected group of elements have been activated one time, the gaming device determines that no elements are activated the predetermined number of times.

If no elements are activated the predetermined number of times the element group generator again selects a group of elements (i.e., displayed as a row or column). Each of the elements in this selected group of elements are then activated. Again, the gaming device determines if any of the elements are activated the predetermined number of times. If not, the element group generator again selects a group of elements (i.e., displayed as a row or column) and activates each of the elements in this selected group of elements. If the gaming device determines that at least one element is activated the predetermined number of times, the gaming device provides an outcome based on one or more of the elements which are activated the predetermined number of times.

In one embodiment, the game includes a multi-group activator that can be generated or selected by the element group generator. In this embodiment, the multi-group activator causes each of the elements in a plurality of element groups to be activated based on the selection of the multi-group activator by the element group generator. In another embodiment, the selection of the multi-group activator causes all of the elements in each of the elements groups (i.e., all of the elements) to be activated based the selection of the multi-group activator by the element group generator. For example, if the predetermined number of times an element can be activated is two and the multi-group activator is selected as the first two selections of the element group generator, then each of the elements in the element groups will be activated the predetermined number of times and the outcome or award provided to the player will be based on any values associated with each of the activated elements.

In one embodiment, the game terminates when an outcome or award is provided to the player. In an alternate embodiment, the player is provided a predetermined number of generations or selections by the element group generator. In this embodiment, the generation of an element group by the element group generator decreases the remaining number of generations by one and the game ends when the player has no remaining generations by the element group generator remaining. In another embodiment, at least one of the element groups includes a terminator element. In this embodiment, if the element group generator generates or selects an element group which includes a terminator element, the game ends. It should be appreciated that any suitable terminating event or terminating condition may be employed in the present invention.

While the present invention is discussed and illustrated primarily with respect to a two dimensional grid, it should be appreciated that any suitable arrangement of elements may be employed in accordance with the present invention.

It is therefore an advantage of the present invention to provide a gaming device with a symbol generation game.

Other objects, features and advantages of the invention will be apparent from the following detailed disclosure, taken in conjunction with the accompanying sheets of drawings, wherein the numerals refer to like parts, elements, components, steps and processes.

DETAILED DESCRIPTION OF THE INVENTION

Figure 1A:
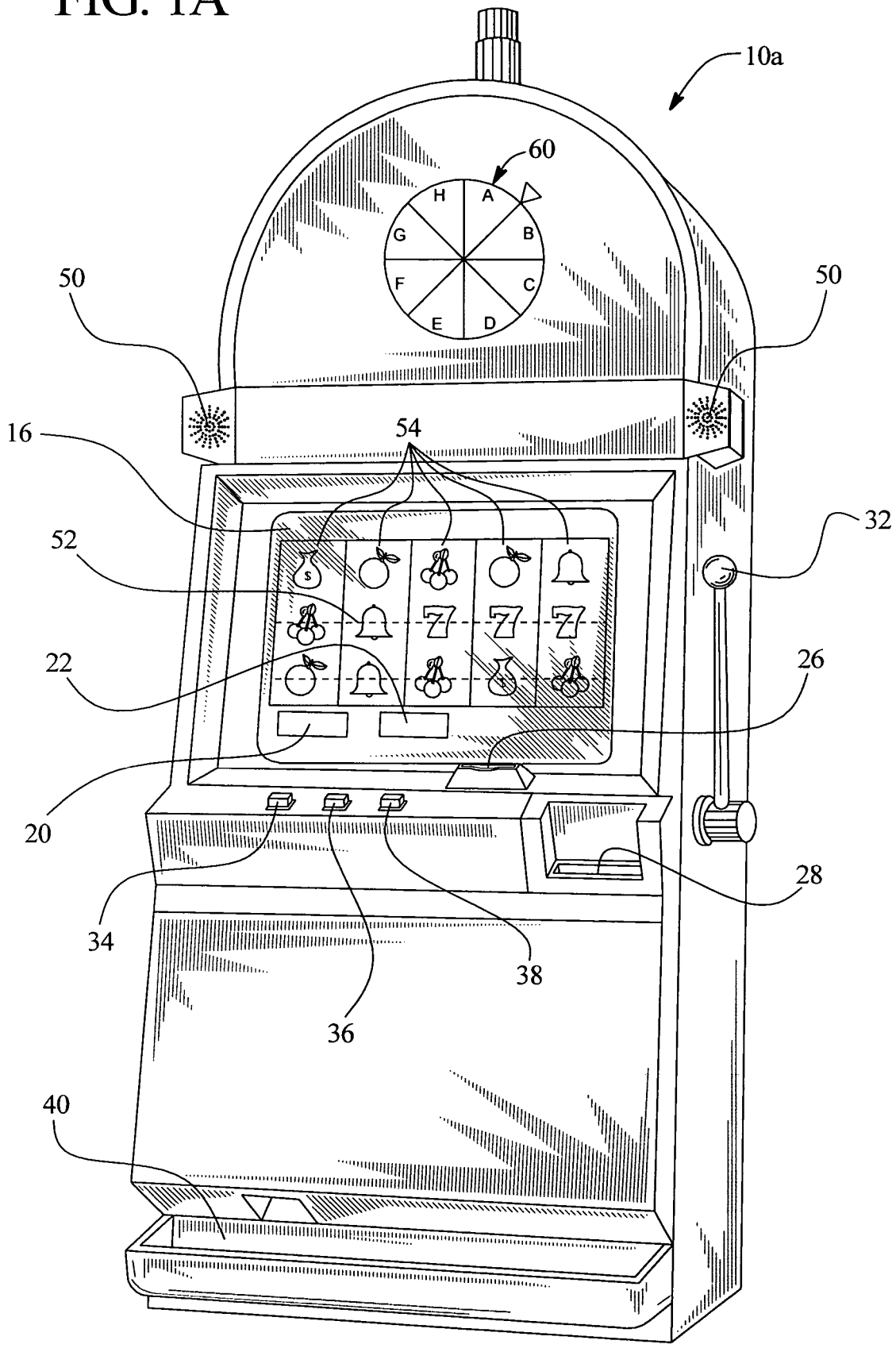
FIGS. 1A and 1B are front-side perspective views of alternative embodiments of the gaming device of the present invention.
Figure 1B:
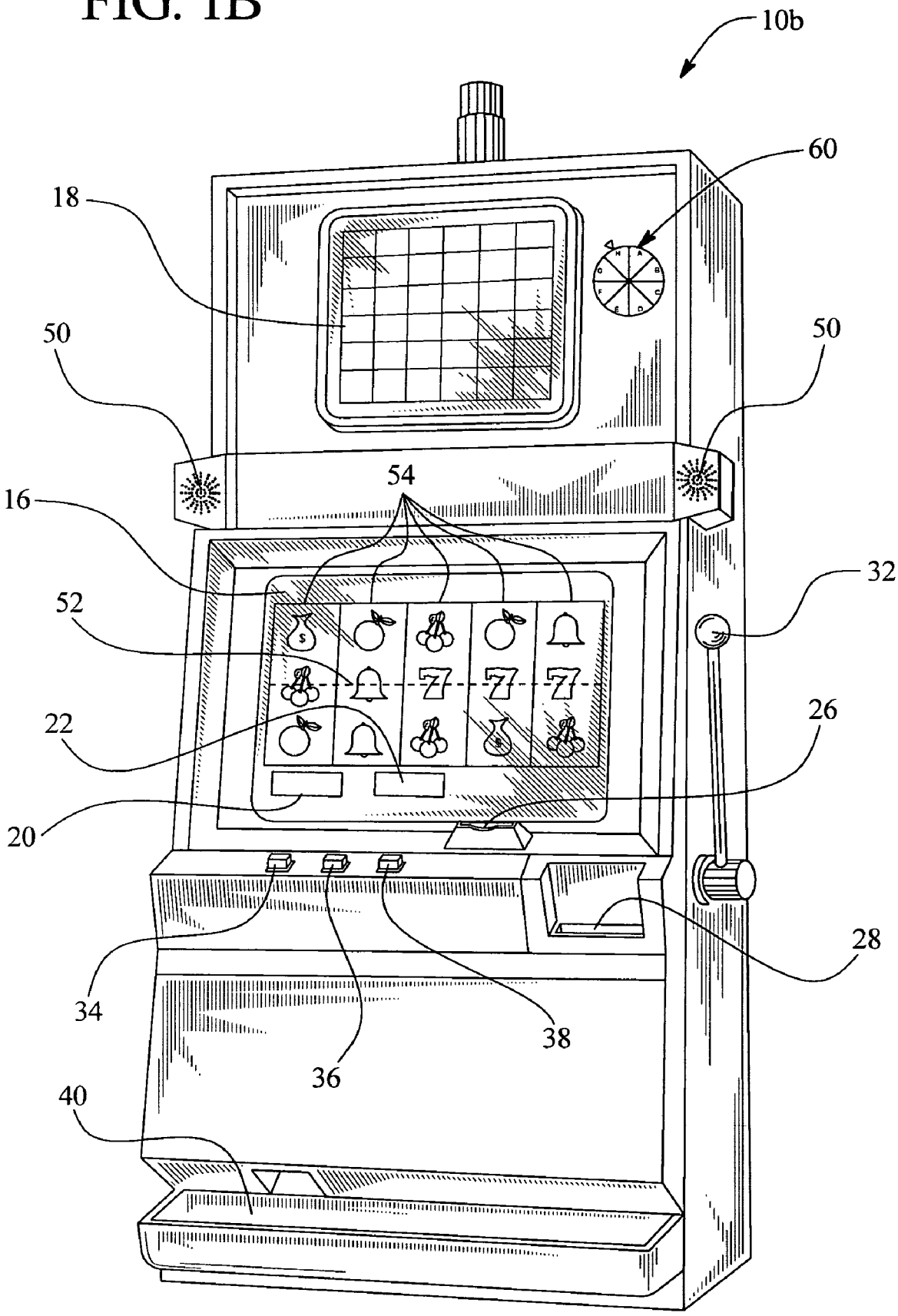

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sifting. The gaming device may be positioned on a base or stand or can be configured as a pub-style table-top game (not shown) which a player can operate preferably while sifting. As illustrated by the different configurations shown in FIGS. 1A and 1B, the gaming device can be constructed with varying cabinet and display configurations.

Figure 2A:
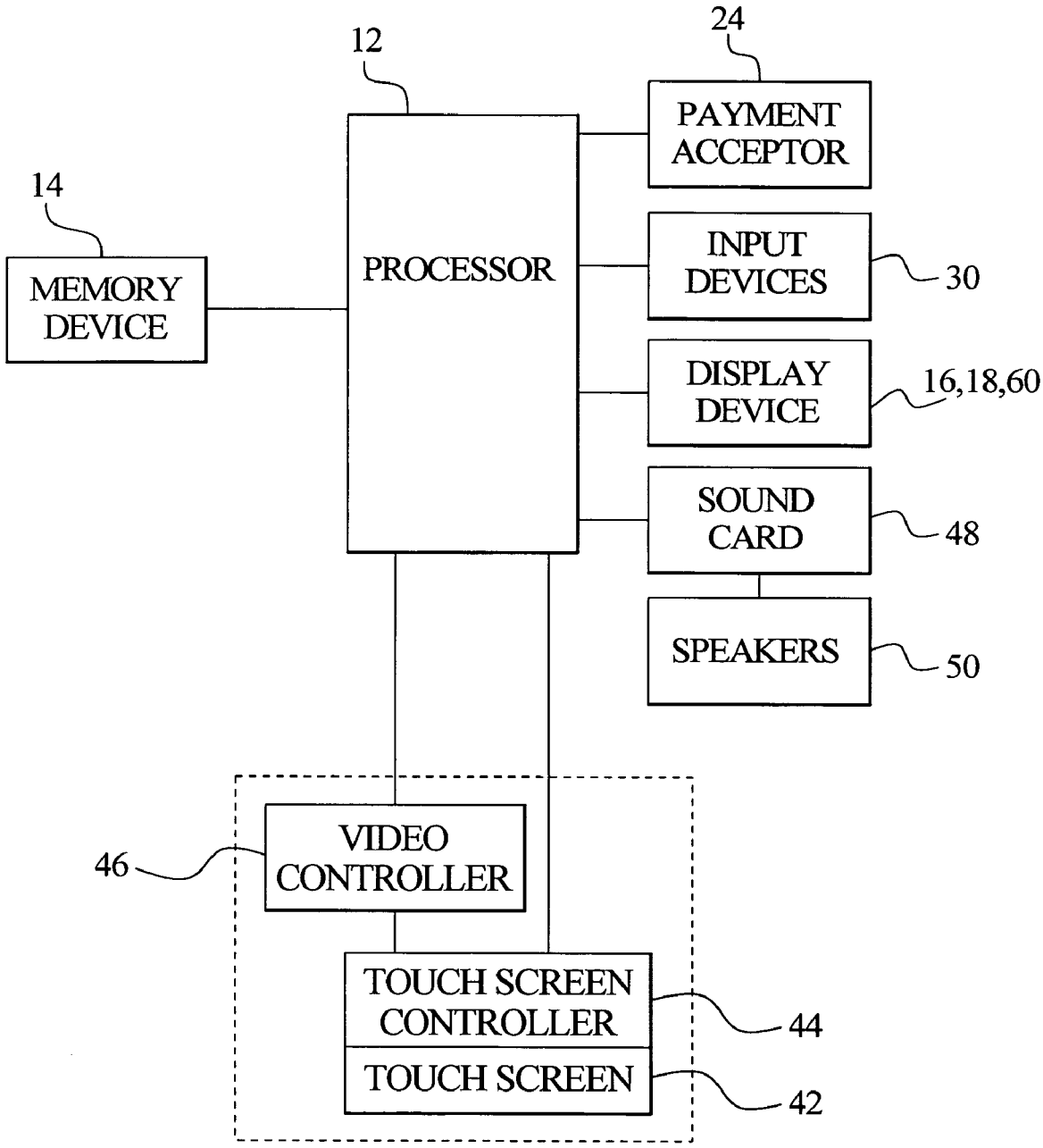
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. In another embodiment, at least one display device may be a mobile display device, such as a PDA or tablet PC, that enables at least a portion of the primary or secondary game to be played at a location remote from the gaming device. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, rectangle, elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. In one embodiment, the display devices include a rotatable wheel 60 with a plurality of sections which is controlled by the processor 12. Each section is associated with one of a plurality of element groups. The rotatable wheel 60 may be a mechanical wheel as depicted in FIG. 1A or a video wheel as depicted in FIG. 1B. The display device may include any electromechanical device, such as one or more mechanical objects, such as one or more reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

Figure 2B:
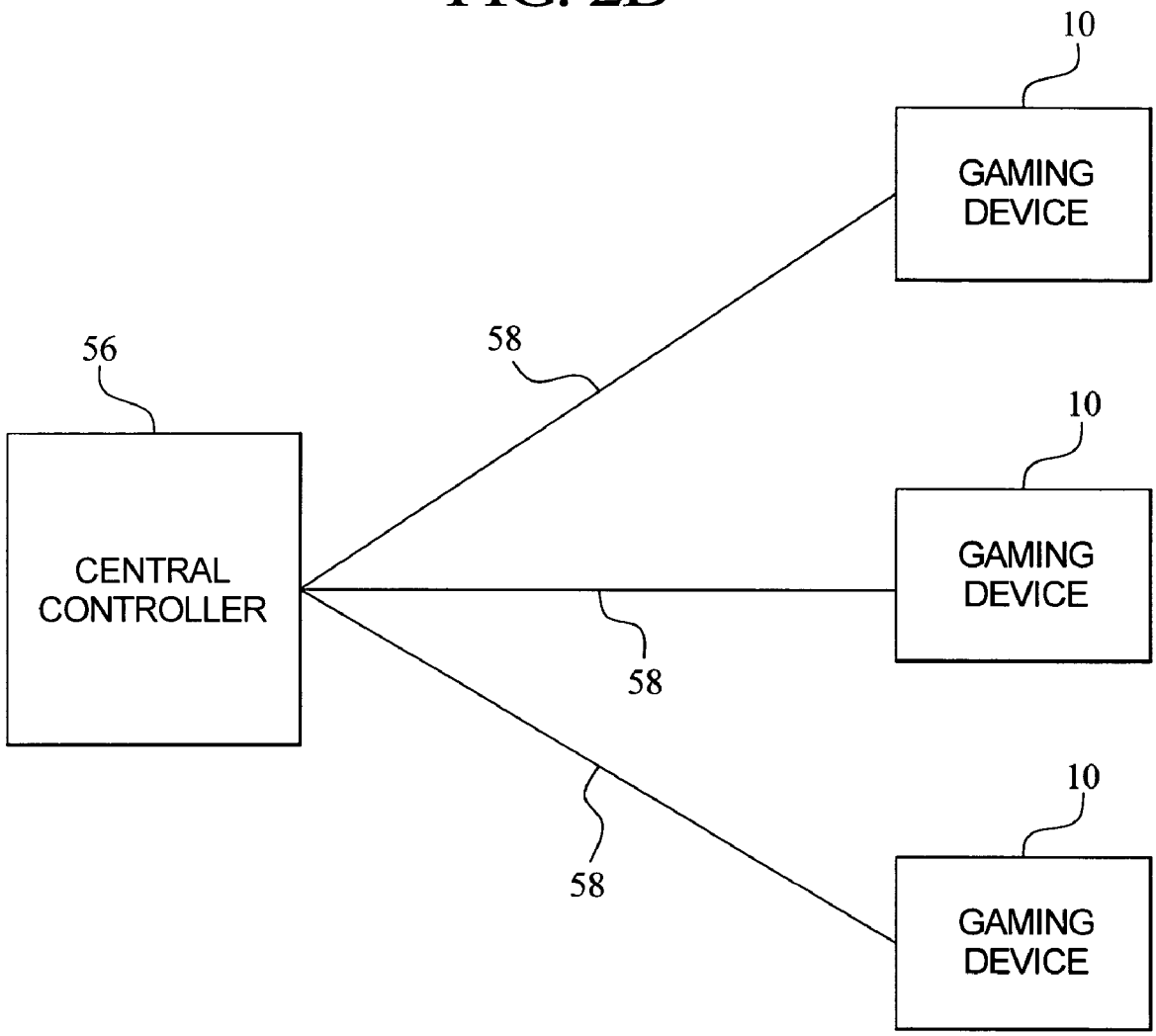
FIG. 2B is a schematic block diagram illustrating a plurality of gaming terminals in communication with a central controller.

In one embodiment, as illustrated in FIG. 2B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital signal line (DSL), T-1 line, coaxial cable, fiber optic cable, or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to and receive information from, the host site computer. Each central server computer is responsible for all data communication between the gaming device hardware and software and the host site computer.

Gaming device 10 can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented into the present invention.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game, rather they must win or earn entry through play of the primary game and thus, play of the primary game is encouraged. In another embodiment, qualification of the bonus or secondary game could be accomplished through a simple "buy in" by the player if, for example, the player has been unsuccessful at qualifying through other specified activities.

Game Scheme

Figure 3:
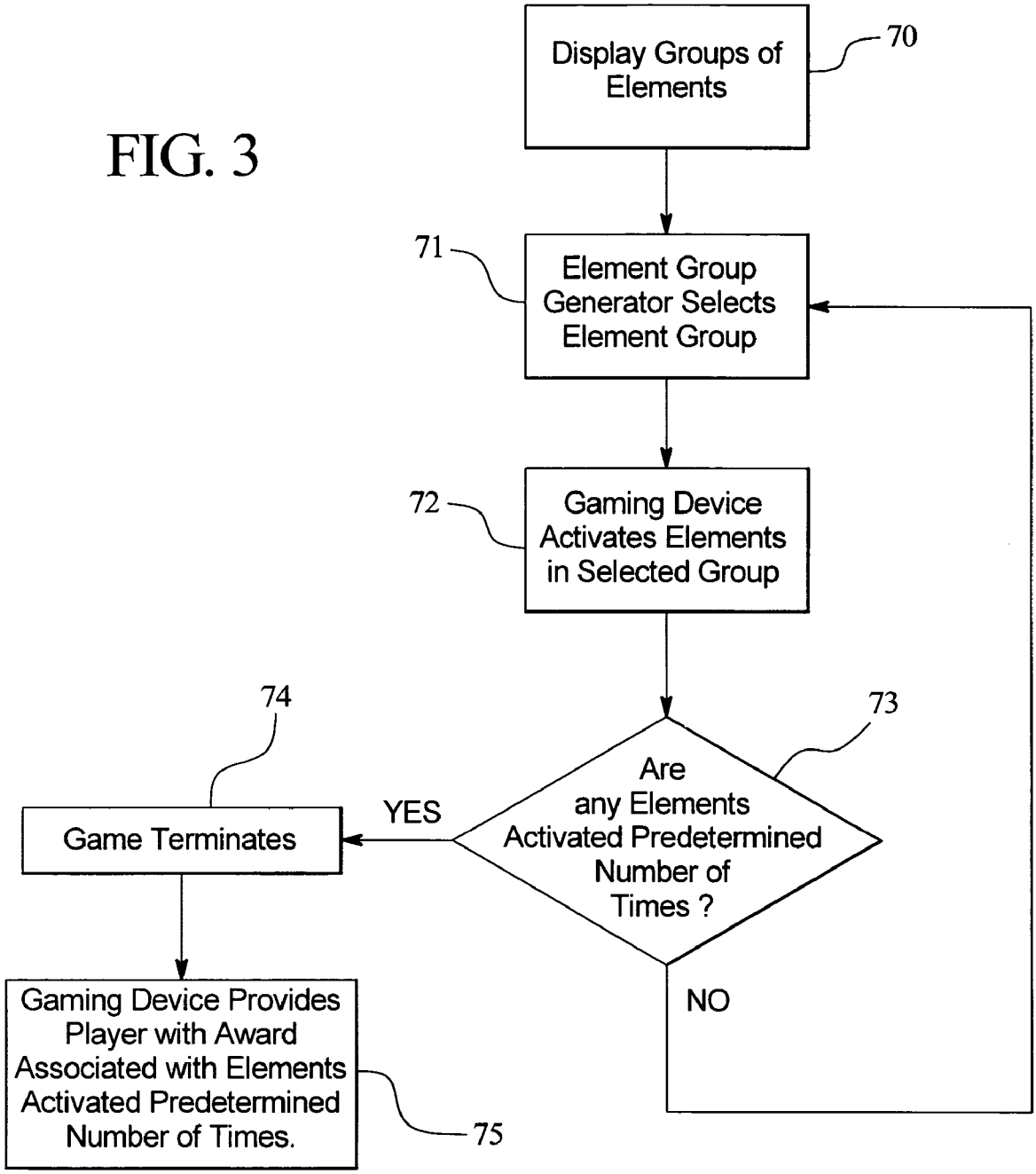
FIG. 3 is a flow diagram of one embodiment of the present invention.

FIG. 3 illustrates one embodiment of the game scheme of the present invention. In this embodiment, the game initiates when a suitable triggering event occurs. With reference to block 70, once the game begins, the gaming device displays a plurality of groups of elements, wherein each group of elements includes at least one and preferably a plurality of elements. An element group generator, such as a rotatable wheel, generates, selects or displays an initial element group as indicated by block 71. After an element group is selected by the element group generator, the corresponding elements of the selected element group are activated as shown by block 72. The gaming device then determines if any of the elements have been activated a predetermined number of times, wherein the predetermined number is at least two as indicated by diamond 73. If an element is activated the predetermined number of times, the game terminates as indicated by block 74 and provides a player an outcome or award based on the elements activated the predetermined number of times as indicated by block 75. If no elements are activated the predetermined number of times, the element group generator selects another element group as depicted by block 71 and the above described process continues until the game terminates.

Figure 4A:
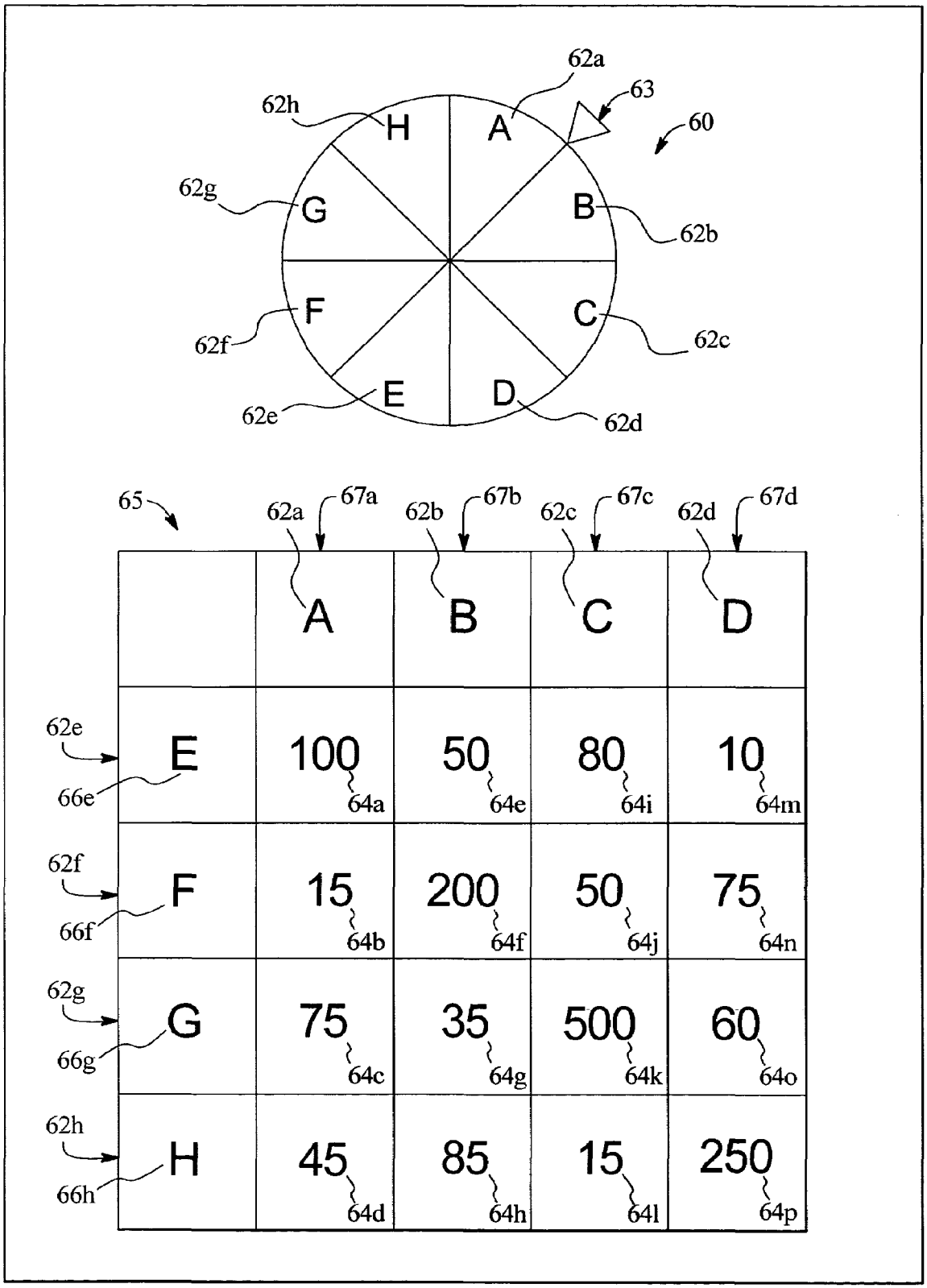
FIGS. 4A, 4B and 4C are front plan views of one embodiment of the present invention illustrating an element group generator, element groups arranged in rows and columns and an element selected the predetermined number of times.
Figure 4B:
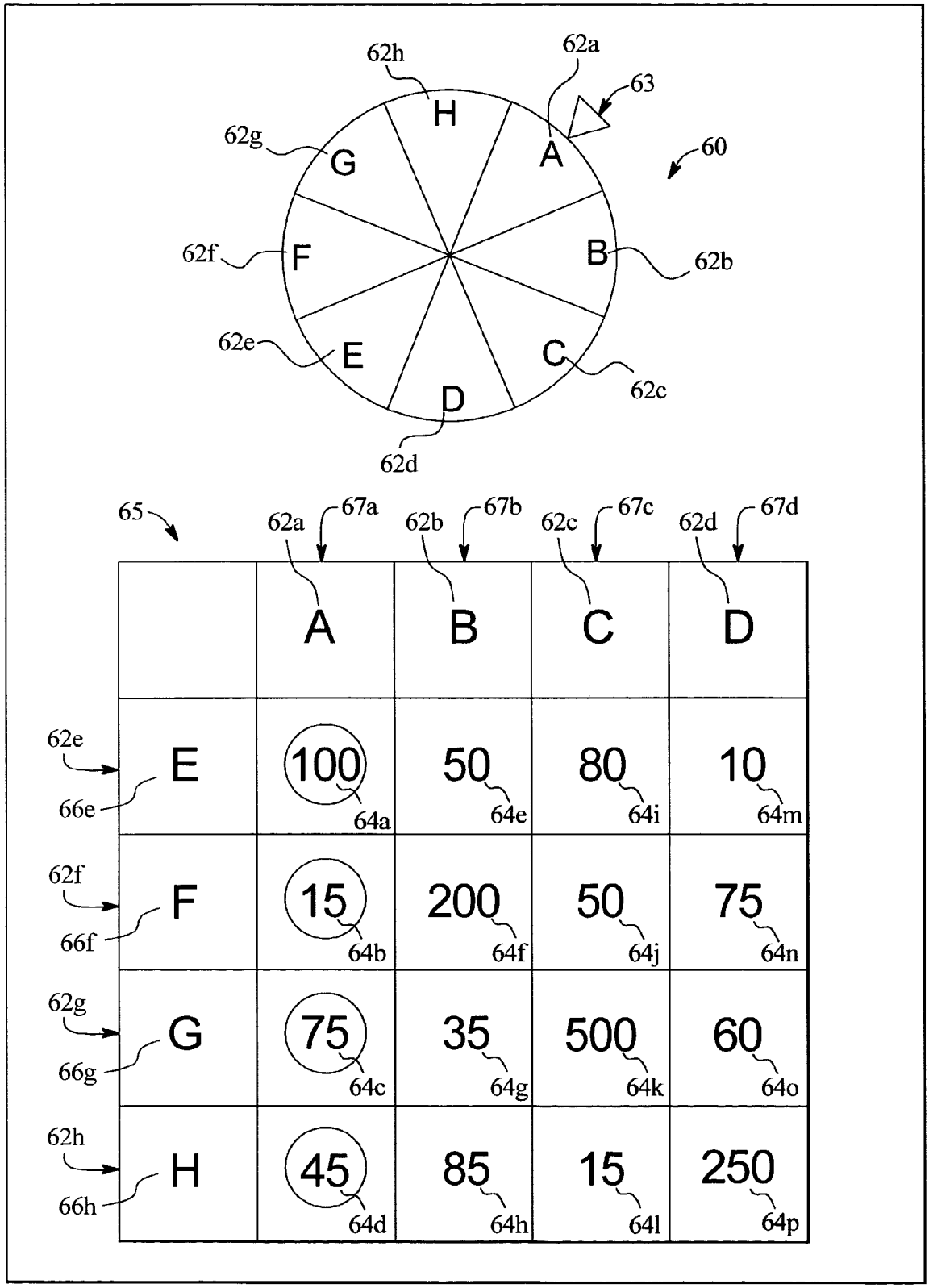
Figure 4C:
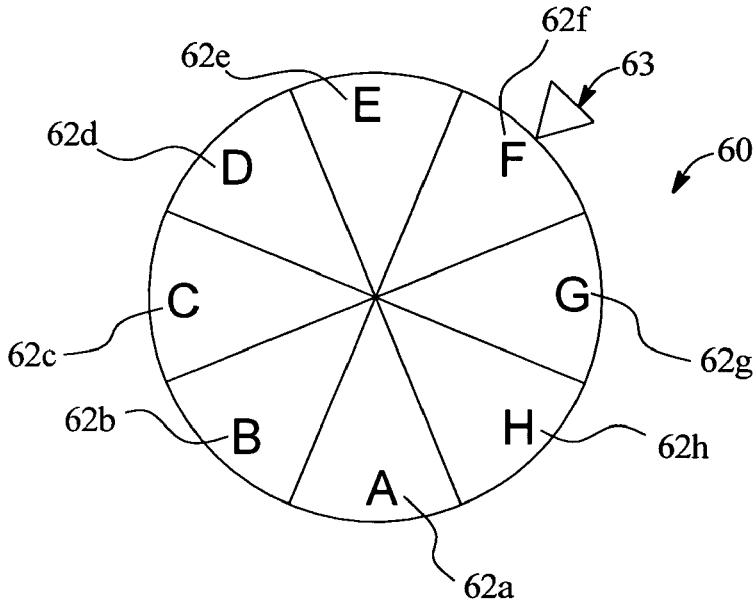

Referring now generally to FIGS. 4A to 4C, one embodiment of the game of the present invention provides a screen or display which displays a grid 65. A plurality of element groups 62*a*, 62*b*, 62*c*, 62*d*, 62*e*, 62*f*, 62*g* and 62*h* are arranged in the grid. Each element group corresponds to either a row or a column of the grid. Element groups 62*a*, 62*b*, 62*c* and 62*d* are arranged as a plurality of column element groups 67*a*, 67*b*, 67*c* and 67*d*, respectively. Element groups 62*e*, 62*f*, 62*g* and 62*h* are arranged as plurality of row element groups 66*e*, 66*f*, 66*g* and 66*h*, respectively. Each row element group and each column element group includes at least one and preferably a plurality of elements 64*a* to 64*p*. In this embodiment each element is in two different element groups, a row element group and column element group.

In the embodiment illustrated in FIGS. 4A to 4C, each element is associated with a value which is displayed to the player. In another embodiment (not shown), each element is associated with a value which is initially masked and revealed when that element is activated. In one embodiment, the value associated with each element is constant for all games. In another embodiment the value associated with each can element change from game to game. In one embodiment, the value associated with an element is displayed next to the corresponding element, either throughout game play or only after the corresponding element is activated. In an alternative embodiment, one or more of the elements are associated with a modifier which is displayed to the player. In this embodiment, the modifier associated with any element which is selected the predetermined number of times is applied to any previously determined award. In another embodiment, one or more of the elements are associated with a terminator. In this embodiment, the terminator associated with any selected element functions to terminate the game. In another embodiment, any suitable outcome may be associated with one or more of the elements.

In another embodiment, the plurality of elements are each not associated with a value or award. In this embodiment, the award provided to the player is based on the number of generations of the element group generator and not on any of the elements which are activated the predetermined number of times. For example, the player is provided a larger award for the greater number of generations that occur prior to at least one of the elements being activated the predetermined number of times.

As illustrated in FIGS. 4A to 4C, in one embodiment, the gaming device includes an element group generator 60, such as a mechanical wheel which includes a plurality of sections. Each section is associated with and displays one of the plurality of element groups of the grid. As described above, each element group displayed on the element group generator corresponds to either a row or column of the grid of elements. For example, the element group 62*a* displayed as an "A" on the element group generator is associated with column 67*a* of the grid of elements which includes elements 64*a*, 64*b*, 64*c* and 64*d*. An indicator 63 such as a result pointer, is associated with the element group generator and adapted to identify each of the displayed element groups of the element group generator. It should be appreciated that the present invention may be implemented with any suitable type of element group generator 60. It should be further appreciated that any suitable method of generating different element groups may be implemented with the present invention. In one embodiment, each of the different element groups are associated with a plurality of selections and the selections are picked to reveal the associated element group. In another embodiment, each element group is randomly selected by the gaming device.

In one embodiment, each element group is randomly determined based on equal probabilities. In another embodiment, each element group is determined based on one or more different weighted probabilities. In one such embodiment, the frequency in which an element group is generated or selected is based on desired statistical probability outcomes associated with the values associated with the elements of that element group. In one embodiment, the probability of activating an element group is inversely proportionate to the values associated with the elements of the element group. For example, the highest valued element would have the lowest probability of being activated. In this embodiment, the elements associated with the low values would have high probabilities of activation.

As illustrated in FIG. 4A, upon the initiation of the game of one embodiment of the present invention, no elements are initially activated. As shown in FIG. 4B, when the element group generator selects one of the plurality of element groups, the corresponding group of elements in the selected element group are activated. In this example, the element group generator selected the "A" element group 62*a*. Accordingly, the game activated elements 64*a*, 64*b*, 64*c* and 64*d* of element group 62*a* which are all located in column 67*a* of the grid. In one embodiment, the game utilizes a light box in order to highlight the activated elements. It should be appreciated that the game is not limited to the use of a light box and may include a variety of different and suitable lighting or highlighting mechanisms.

After activating each of the elements in the selected element group, the gaming device determines if any of the elements have been activated a predetermined number of times, such as two times. If any of the elements have been activated the predetermined number of times, an outcome is provided to the player. In one embodiment, the provided outcome is based on any value or award associated with those activated elements.

If none of the elements have been activated the predetermined number of times, the element group generator selects another element group and each of the elements of the selected element group are activated. In the example shown in FIG. 4C, the element group generator next selected the "F" element group 62*f*. Accordingly, as described above, after the "F" element group is selected, the gaming device activates each of elements 64*b*, 64*f*, 64*j* and 64*n* which are located in the corresponding row 66*f* of the grid. At this point, the gaming device again determines if any of the elements are activated the predetermined number of times. As seen in FIG. 4C, since the predetermined number of times is two and element 64*b* is activated twice (i.e., once because element 64*b* resides in the column 67*a* which corresponds to the first element group 62*a* selected and once because element 64*b* resides in the row 66*f* which corresponds to the second element group selected 62*f*), an outcome is provided to the player. After an outcome is provided to the player, the game terminates and the gaming device provides the player with any payout due. In one embodiment, the payout due is the value associated with the element which is activated the predetermined number of times. In this case the value of fifteen associated with element 64*b* is displayed to and awarded to the player. In another embodiment, the award provided to the player is independent of the element which is activated the predetermined number of times. In another embodiment, the outcome provided to the player is based on the number of different element groups selected. In another embodiment, the outcome provided to the player is based on the number of times the element group generator selected element groups until one of the elements was activated the predetermined number of times.

As described above, if no elements are selected the predetermined number of times, the gaming device will generate an element group again. The gaming device continues to initiate the element group generator and activate each of the elements in the selected element group until at least one element is activated the predetermined number of times.

In one embodiment, if an element group is selected by the element group generator more than once, than each of the elements in the selected element group will only be activated once. In another embodiment, if an element group is selected more than once in a row by the element group generator, then each of the elements in the twice selected element group will only be activated once. In another embodiment, each time the element group generator selects one of the element groups, the elements in the selected element group will be activated.

In an alternate embodiment, the gaming device determines the number of selections of element groups (via the element group generator) provided to the player. In this embodiment, the element group generator continues selecting element groups and each of the elements corresponding to the selected element group are activated until the player has no remaining selections of the element groups. When the player has no remaining selections of the element groups, the gaming device provides the player an award based on the awards or values associated with each of the elements that have been activated at least the predetermined number of times. In one embodiment, the number of selections of the element groups may be randomly determined, predetermined, based on the player's wager, determined based on the play of a primary game or determined in any other suitable fashion In one embodiment, in addition to providing the player the awards or values associated with one or more of the elements which are activated the predetermined number of times, an additional or supplemental award is provided to the player based on the number of generations of the element group generator. In another embodiment, the supplemental award is based on the number of activations of one or more designated elements. In one embodiment, the player is enabled to pick or designate one or more elements and any supplemental award is based on the number of activations of the player picked elements.

Figure 5A:
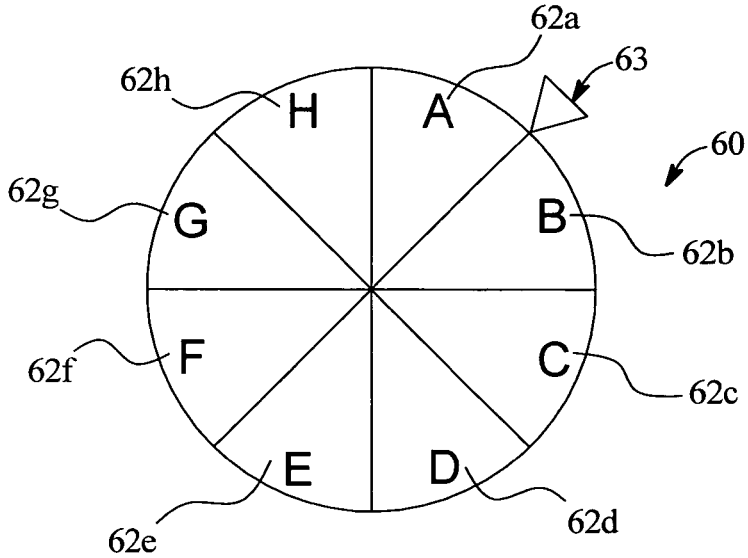
FIG. 5A is a front plan view of another embodiment of the present invention illustrating the display of the grid embodiment after two element groups have been selected.

FIG. 5A illustrates one embodiment of the game of the present invention after two element groups have been selected. As illustrated in FIG. 5, element groups 62*b* and 62*d* have been previously selected and thus elements 64*e*, 64*f*, 64*g* and 64*h* of group 62*b* in column 67*b* and elements 64*m*, 64*n*, 64*o* and 64*p* of group 62*d* in column 67*d* have been activated accordingly.

Figure 5B:
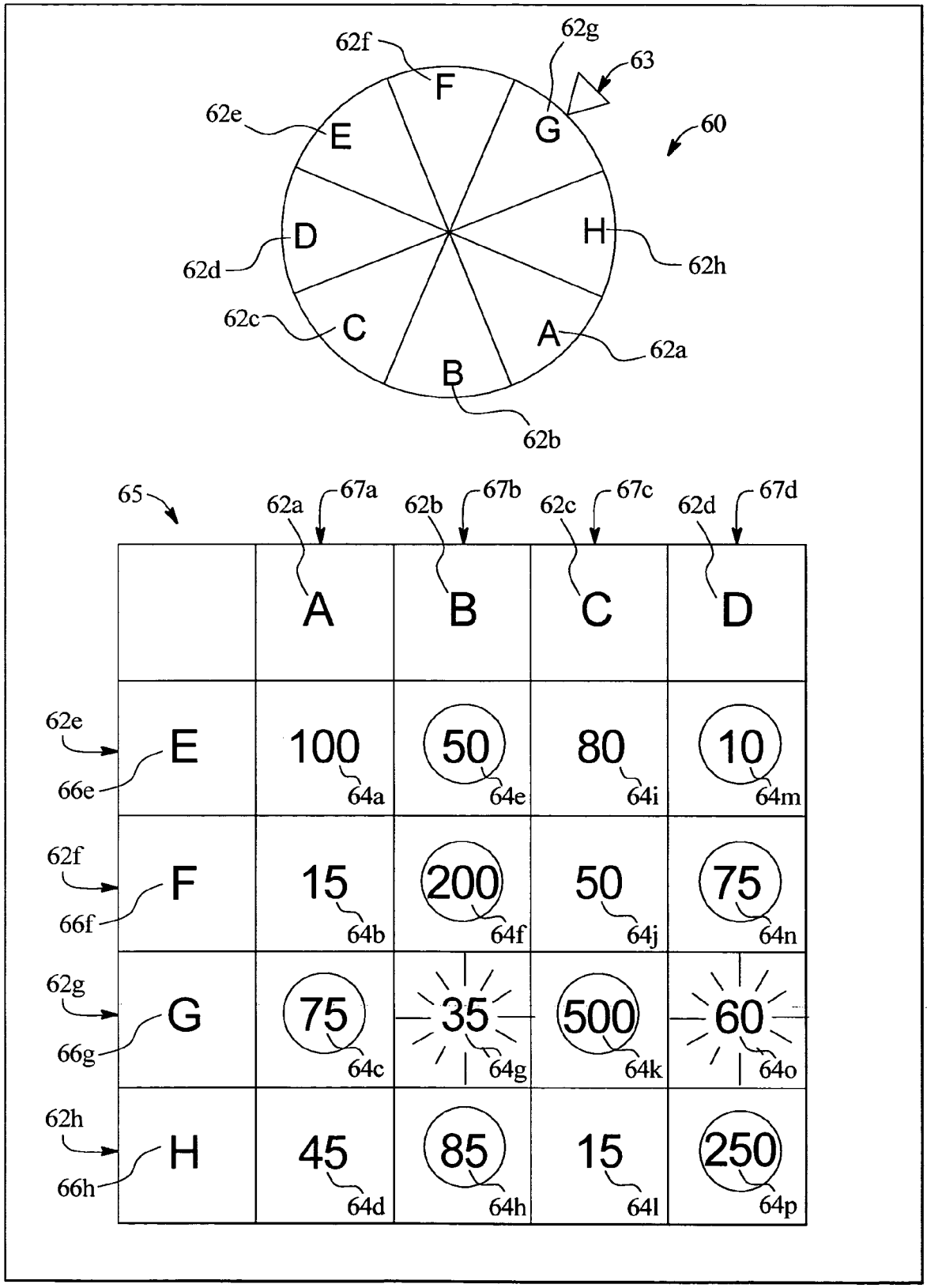
FIG. 5B is a front plan view of the embodiment of FIG. 5A displaying the grid after a third element group is selected and a win condition is established by two elements.

As shown in FIG. 5B, a subsequent selection of element group "G" 62*g* activates the elements 64*c*, 64*g*, 64*k* and 64*o* of row 66*g*. In this embodiment, the predetermined number of activations is two and since elements 64*g* and 64*o* are in two of the three element groups 62 that have been selected, the values associated with both elements 64*g* and 64*o* are provided to the player. In this case, a total value of ninety-five resulting from the combination of the value of thirty-five associated with element 64*g* and the value of sixty associated with element 64*o* is provided to the player. In one embodiment, the value associated with one of the elements activated the predetermined number of times is provided to the player. In another embodiment, the values associated with a plurality of the elements activated the predetermined number of times are provided to the player. In another embodiment, the values associated with each of the elements activated the predetermined number of times is provided to the player.

Figure 6A:
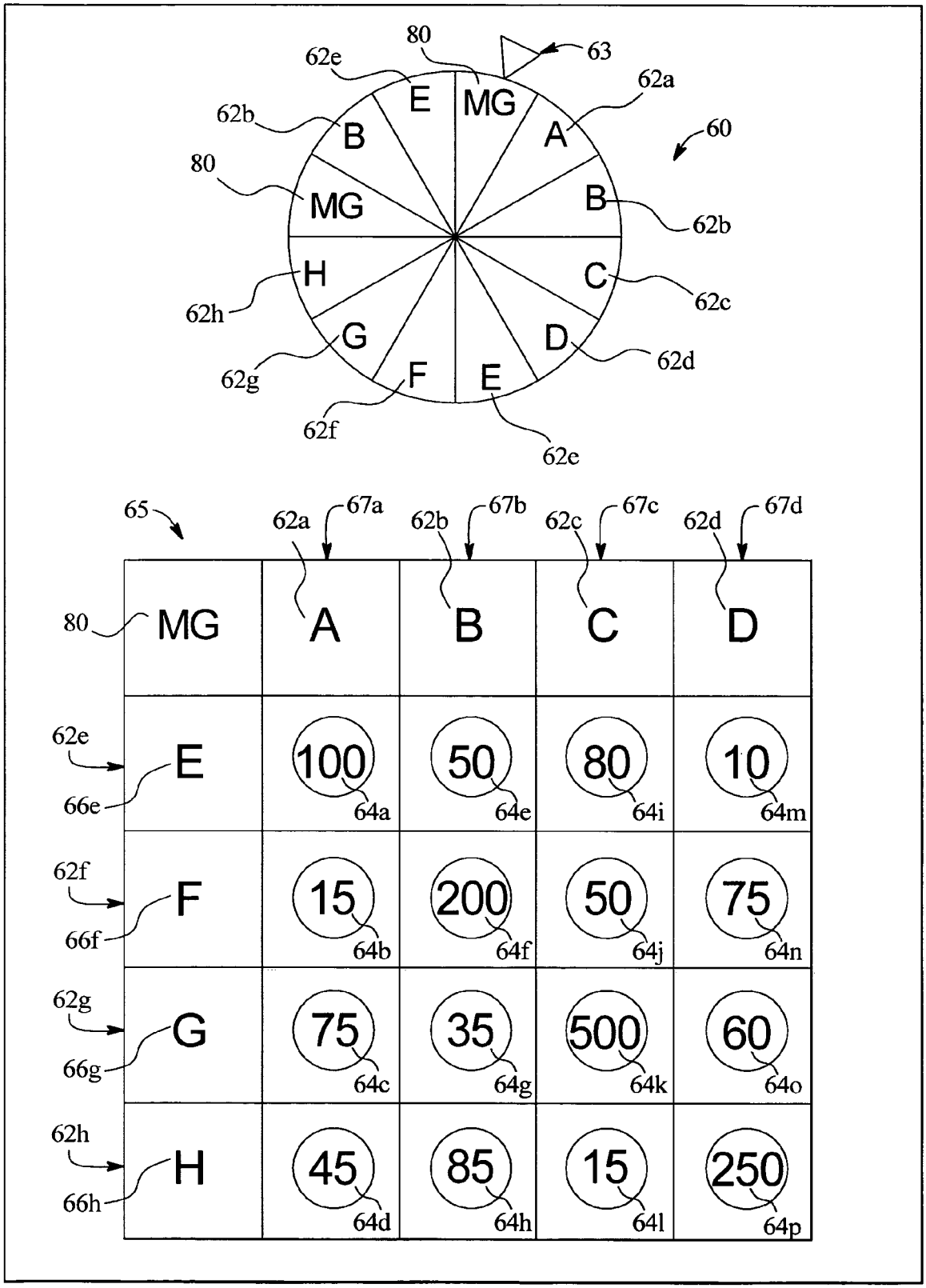
FIGS. 6A and 6B are front plan views of an alternative embodiment of the present invention illustrating an element group generator, a multi-group activator and the selection of a plurality of elements.

As illustrated in FIG. 6A, in another embodiment of the present invention, the element group generator is adapted to generate or select a multi-group activator 80 illustrated as a "MG" on the element group generator. In one embodiment, the multi-group activator is adapted to cause each of the elements of a plurality of element groups to be activated. In one embodiment, the elements activated by the multi-group activator are the elements in a plurality of row element groups, elements in a plurality of column element groups or both. In another embodiment the multi-symbol activator is adapted to cause the activation of all of the elements in each of the element groups.

Figure 6B:
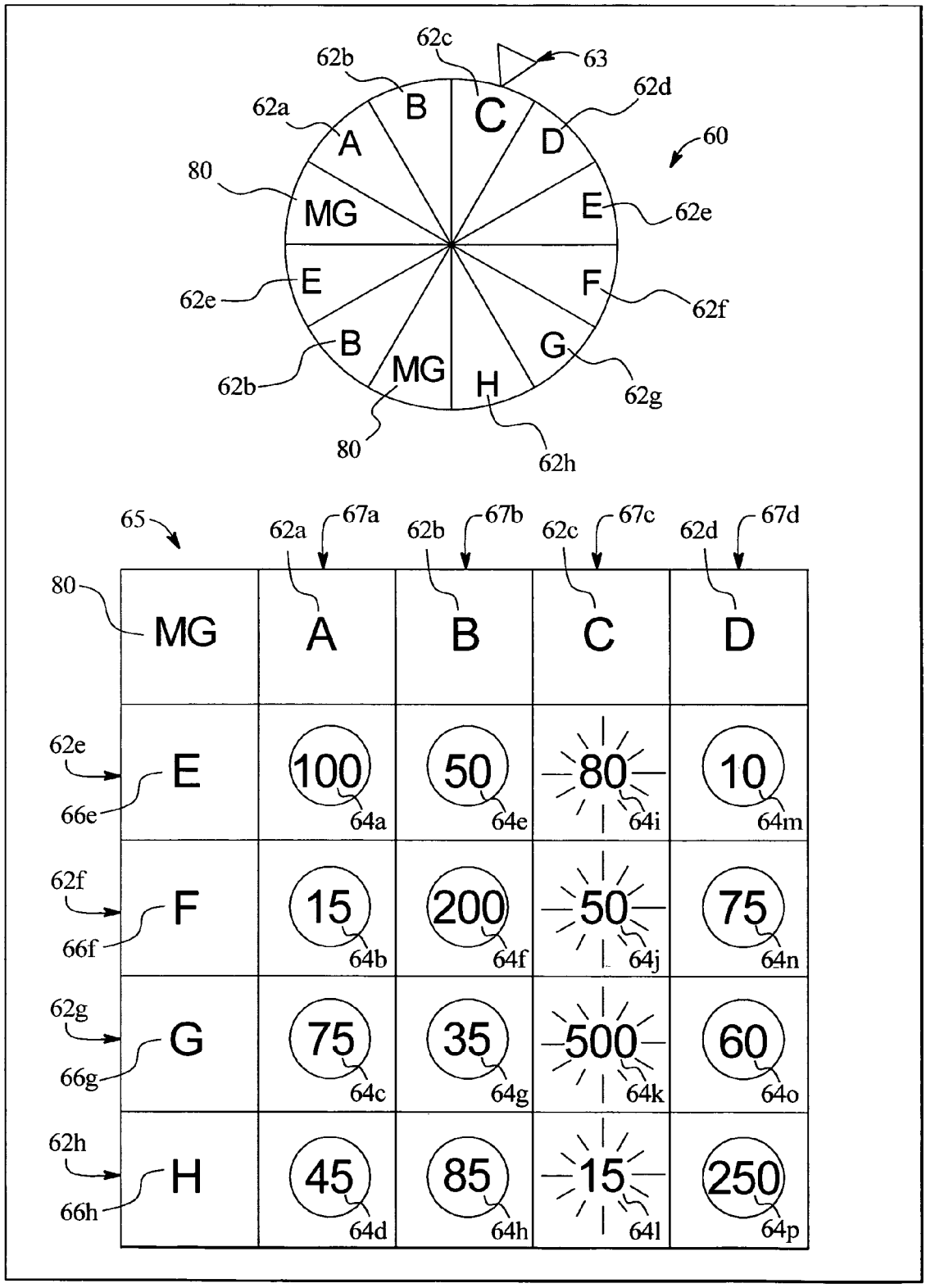

In the example illustrated in FIG. 6A, the element group generator has selected the multi-group activator 80. In this embodiment, the multi-group activator activates each of the element in each of the element groups and thus each of the elements 64*a* to 64*p* are activated. As seen in FIG. 6B, the subsequent selection of element group "C" 62*c* activates elements 64*i*, 64*j*, 64*k* and 64*l* residing in column 67*c*. As each of the elements in element group 62*c* were previously activated by the multi-group activator, the values associated with each of the elements of element group 62*c* are provided to the player. In this case, a total value of six-hundred-forty-five is provided to the player based on the values of 80, 50, 500 and 15 associated with elements 64*i*, 64*j*, 64*k* and 64*l*, respectively.

Figure 7A:
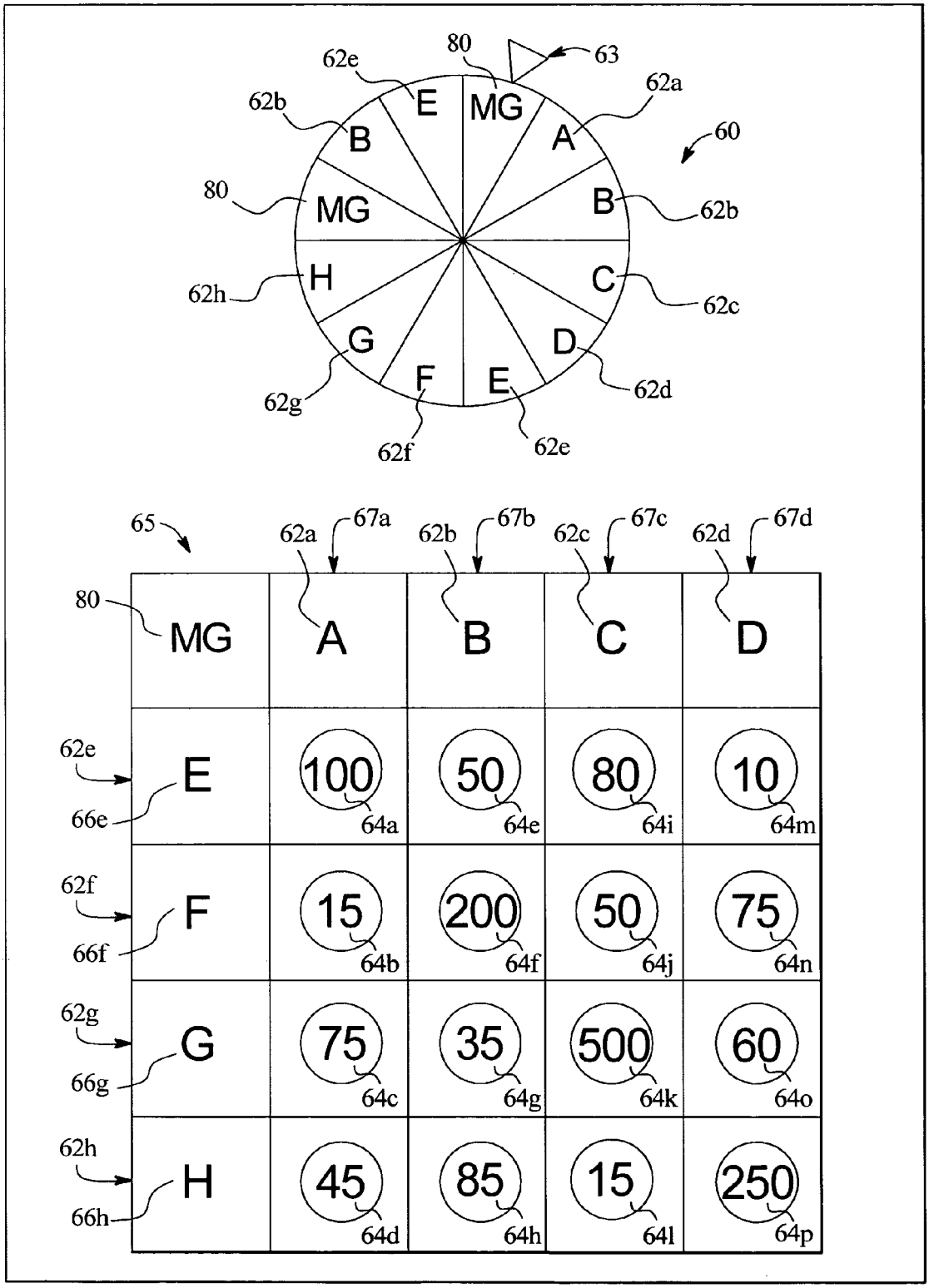
FIG. 7A is a front plan view of another embodiment of the present invention illustrating an initial selection of the multi-group indicator.
Figure 7B:
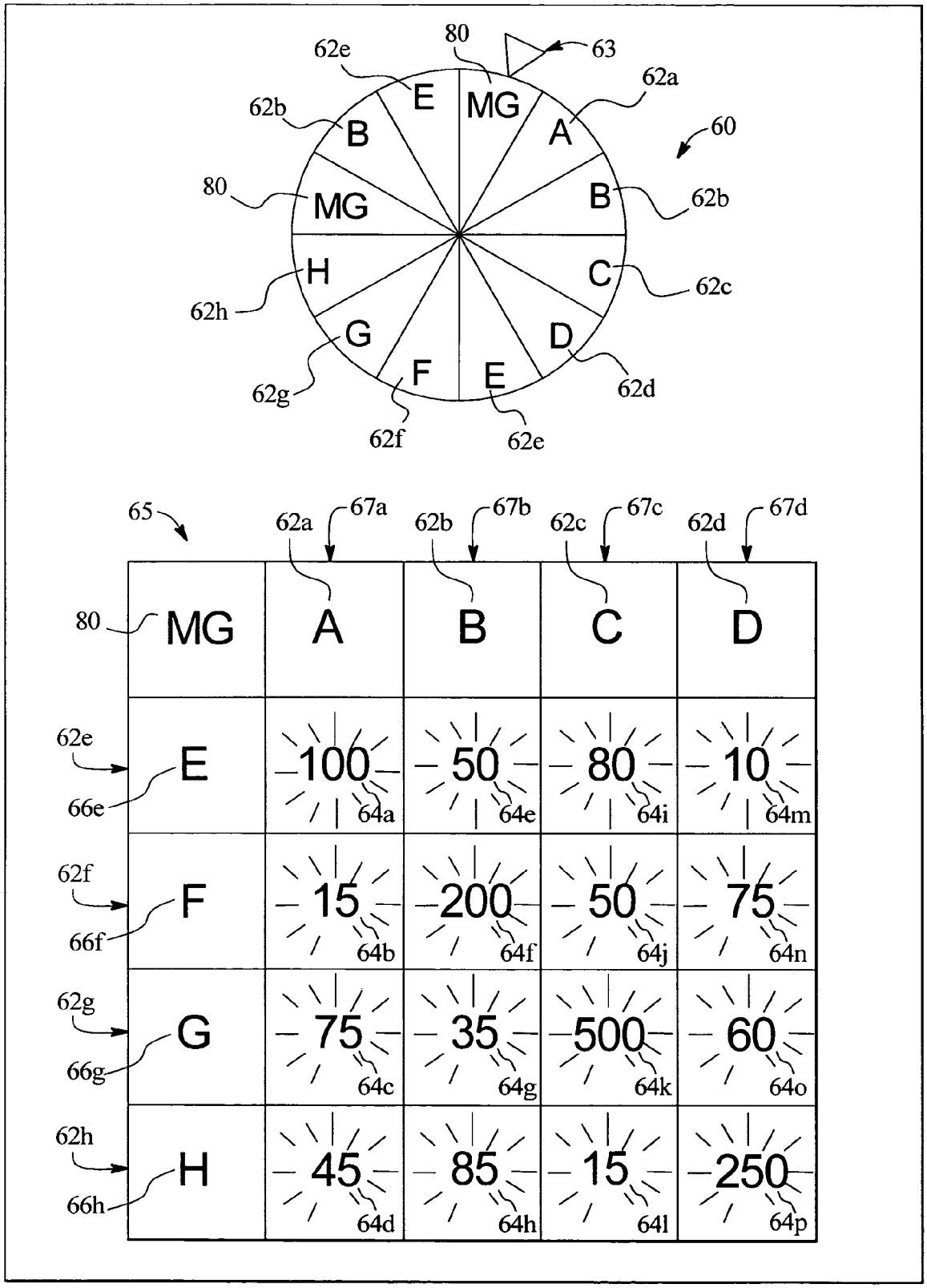
FIG. 7B is a front plan view of the embodiment of FIG. 7A displaying the grid embodiment after a second multi-group indicator is selected and a win condition is established by all of the elements.

In the embodiment illustrated in FIG. 7A, the element group generator has initially selected the multi-group activator 80 wherein the multi-group activator activates each of the elements in each of the element groups. As seen in FIG. 7B, the subsequent selection of the multi-group activator again activates each of the elements in each of the element groups. In this case, because the second selection of the multi-group activator activates each of the elements and these elements were all previously activated by the first selection of the multi-group activator, the values associated with each of the elements are provided to the player. Therefore, the multi-group activator provides the player the opportunity to obtain the outcomes associated with each of the elements in each of the element groups.

In one embodiment, the multi-group activator is associated with a plurality of the groups of elements. In this embodiment, when the multi-group activator is selected, each of the elements in each of the element groups associated with the selected multi-group activator are activated. In another embodiment, the gaming device includes a plurality of different multi-group activators which are each associated with a different plurality of element groups. In another embodiment, the player is enabled to select the element groups to be associated with each multi-group activator. In this embodiment, if the multi-group activator is selected, each of the elements in each of the player selected element groups are activated.

In one embodiment, one or more sections of the element group generator are associated with individual elements. In this embodiment, the element group generator is adapted to generate, select or display a single element from one of the element groups. Rather than activating each element in a selected element group, the gaming device activates the single element selected by the element group generator. In another embodiment, the element group generator generates, selects or displays a plurality of, but not all of the elements from one of the element groups. In this embodiment, the gaming device activates the plurality of elements selected by the element group generator.

In one embodiment, one or more sections of the element group generator are associated with a deactivator. In this embodiment, if the element group generator selects a section associated with a deactivator, the gaming device deactivates one or more of the previously activated elements. In another embodiment, if the element group generator selects a section associated with a deactivator, the gaming device deactivates each of the previously activated elements from one or more of the previously selected element groups.

The present invention is not limited to a square or rectangular-shaped grid as detailed above. While the present invention is discussed and illustrated primarily with respect to a two dimensional grid, it should be appreciated that any suitable arrangement of element groups may be employed in accordance with the present invention. A variety of different matrix shapes or scattered arrangements may be utilized to facilitate and enhance the enjoyment and entertainment objectives of the present invention.

Figures 8, 9:
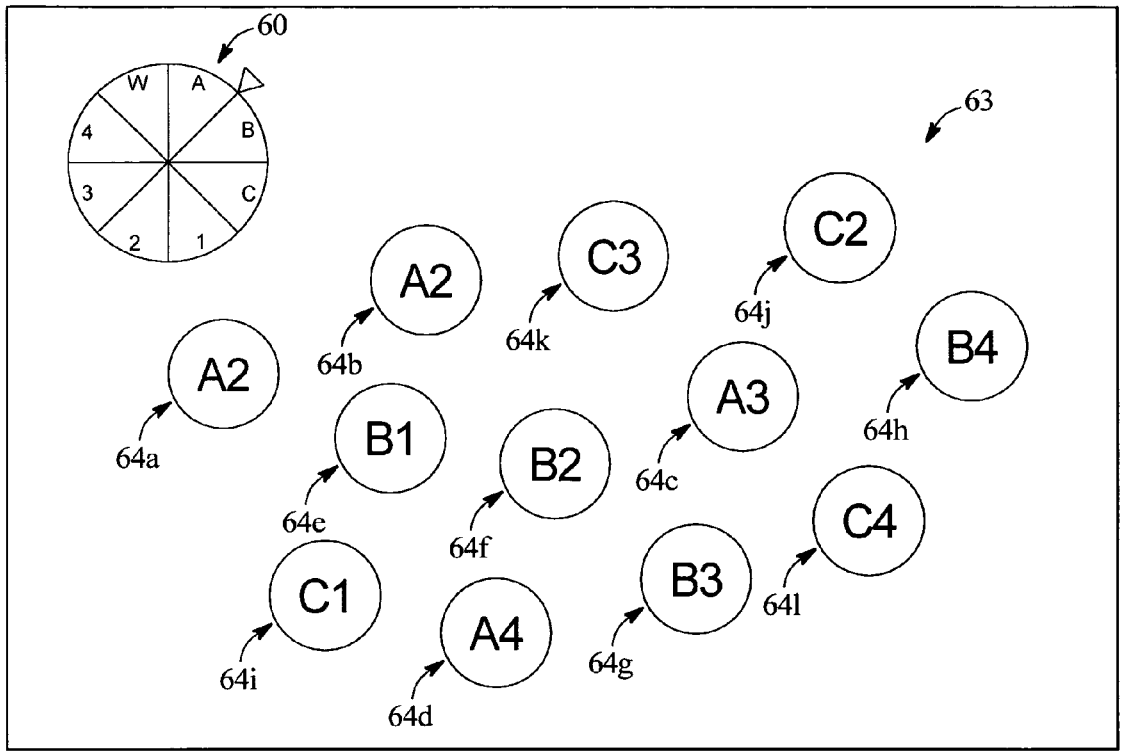
FIG. 8 is a front plan view of another embodiment of the present invention illustrating scattered element groups.
FIG. 9 is a chart illustrating a set of elements and their associated values.

In one alternative embodiment, as illustrated in FIGS. 8 and 9, the plurality of elements 64*a* to 64*l* are in a scattered arrangement instead of an ordered grid. In this embodiment, each element is in two different element groups. For example, if the element group generator 60 selects the "B" element group, then each of the elements which are in the "B" element group, in this case elements 64*e*, 64*f*, 64*g* and 64*h* are activated. This embodiment proceeds as described above until one or more elements are activated the predetermined number of times. In this embodiment, when one or more elements have been activated the predetermined number of times, a value associated with the elements activated the predetermined number of times is provided to the player. As seen in FIG. 9, in this embodiment, each element 64*a* to 64*l* is associated with a value 68*a* to 68*l* and the value associated with the element which is activated the predetermined number of times is provided to the player. For example, if element 64*f* is activated the predetermined number of times, then an award of fifteen is provided to the player and the game ends.

Figure 10:
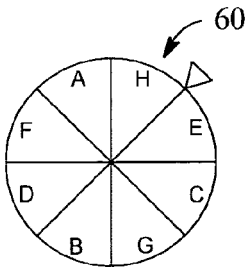
FIG. 10 is a front plan view of another embodiment of the present invention illustrating one element included in only one element group.

In another embodiment, as illustrated in FIG. 10, at least one element 70 is only included in one element group. In this embodiment, while a plurality of the elements 64 are included in at least two element groups (i.e., one row and one column), element 70 is only included in one element group. In one embodiment, since the element group which includes the single element group element must be selected by the element group generator the predetermined number of times in order to activate single element group element the predetermined number of times, the single element group element may be associated with a top award. For example, assuming there is an equal probability of the element group generator selecting any of the element groups, for an element which is in element groups "A" and "F" to be activated a predetermined number of two times, either element group "A" needs to selected twice, element group "F" needs to be selected twice or element group "A" needs to be selected once and element group "F" needs to be selected once. On the other hand, for the element which is only in element group "B" to be activated the predetermined number of two times, element group "B" must be selected twice. Accordingly, in this embodiment as there is a greater likelihood of the element in groups "A" and "F" to be activated before the element which is only in element group "B", the element in element group "B" is associated with the top award.

Figure 11:
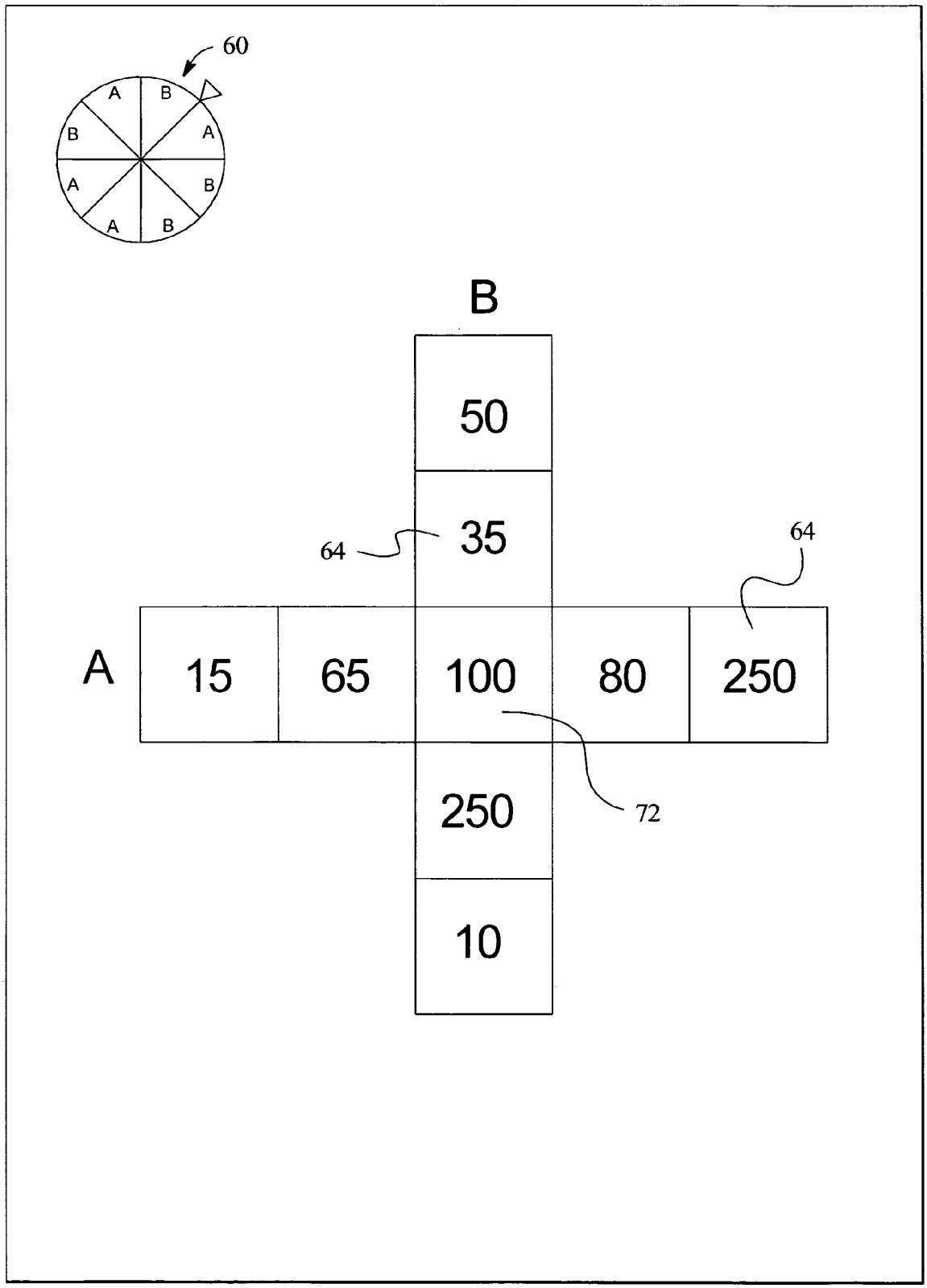
FIG. 11 is a front plan view of another embodiment of the present invention illustrating only one of the element included in a plurality of element groups.

In another embodiment, only one element is included in two different element groups. In this embodiment, as illustrated in FIG. 11, while a plurality of the elements 64 are included in only one element group (i.e., a row or a column), element 72 is only included in two element groups (i.e., a row and a column). In this embodiment, assuming there is an equal probability of the element group generator selecting any of the element groups, the only element which is included in two element groups has a greater likelihood of being activated the predetermined number of activations than any of the elements which are included in only one element group.

In an alternate embodiment, the element group generator can generate a non-activating selection. The non-activating selection does not cause any element groups to be selected, thus no elements are activated. In one example, if the player is limited to two selections of element groups from the element group generator and the predetermined number of activations is two, if a non-activating selection is generated or selected by the element group generator, then no award is provided to the player because no elements can be activated the predetermined number of times, in this case twice.

While the present invention is described in connection with what is presently considered to be the most practical and preferred embodiments, it should be appreciated that the invention is not limited to the disclosed embodiments and is intended to cover various modifications and equivalent arrangements included within the spirit and scope of the claims. Modifications and variations in the present invention may be made without departing from the novel aspects of the invention as defined in the claims and this application is limited only by the scope of the claims.

The invention is claimed as follows:

1. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) cause an element group generator to generate and display one of a plurality of element groups or a multi-group activator, wherein the plurality of element groups each include a plurality of elements, each of said elements is in at least two different element groups and the multi-group activator is associated with each of the elements in a plurality of said element groups;

(b) if one of said element groups is generated and displayed, activate each of the elements in the generated element group;

(c) if said multi-group activator is generated and displayed, activate each of the elements in said different element groups associated with said multi-group activator, wherein said activation of each of the elements in the plurality of different element groups associated with the multi-group activator occurs regardless of any previous activation of any of said elements;

(d) determine if any of the elements are activated a predetermined number of times, wherein said predetermined number of times is at least two;

(e) provide a player any awards associated with any elements activated the predetermined number of times; and (f) repeat steps (a) to (e) until at least one element is activated the predetermined number of times, wherein if one of the element groups is generated and displayed a plurality of times, each of the elements in said element group are activated said plurality of times.

2. The gaming device of claim 1, wherein the element group generator includes a mechanical device.

3. The gaming device of claim 1, wherein the element groups are displayed in a grid configuration including a plurality of rows and a plurality of columns.

4. The gaming device of claim 1, wherein said multi-group activator is associated with each of the element groups.

5. The gaming device of claim 1, wherein when executed by the at least one processor, the plurality of instructions cause the at least one processor to repeat steps (a) to (e) until a plurality of elements are activated the predetermined number of times.

6. The gaming device of claim 1, wherein when executed by the at least one processor, the plurality of instructions cause the at least one processor to repeat steps (a) to (e) until each of said elements are activated the predetermined number of times.

7. The gaming device of claim 1, wherein a terminating event occurs after a predetermined number of generations of one of the plurality of element groups or the multi-group activator.

8. The gaming device of claim 1, wherein a probability of generating one of the element groups is inversely proportional to the awards associated with the elements of said element group.

9. The gaming device of claim 1, wherein a probability of activating one of the elements is inversely proportional to the award associated with said element.

10. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) select and display one of a plurality of element groups or a multi-group activator, wherein a plurality of said element groups each include a plurality of elements and each of said elements is in at least two different element groups and the multi-group activator is associated with each of the elements in a plurality of said element groups;

(b) if one of said element groups is selected and displayed, activate each of the elements in the selected element group;

(c) if said multi-group activator is selected and displayed, activate each of the elements in the different element groups associated with said multi-group activator, wherein said activation of each of the elements in the plurality of different element groups associated with the multi-group activator occurs regardless of any previous activation of any of said elements (d) determine if any of the elements are activated a predetermined number of times, wherein said predetermined number of times is at least two;

(e) provide a player an outcome based on any of said elements which are activated the predetermined number of times; and (f) repeat steps (a) to (e) until at least one element is activated the predetermined number of times, wherein if one of the element groups is selected and displayed a plurality of times, each of the elements in said element group are activated said plurality of times.

11. The gaming device of claim 10, wherein the element groups are displayed in a grid configuration includes a plurality of rows and a plurality of columns.

12. The gaming device of claim 10, wherein the multi-group activator is associated with each of said element groups.

13. The gaming device of claim 10, wherein when executed by the at least one processor, the plurality of instructions cause the at least one processor to repeat steps (a) to (e) until a plurality of elements are activated the predetermined number of times.

14. The gaming device of claim 10, wherein when executed by the at least one processor, the plurality of instructions cause the at least one processor to repeat steps (a) to (e) until each of said elements are activated the predetermined number of times.

15. The gaming device of claim 10, wherein a terminating event occurs after a predetermined number of selections of one of the plurality of element groups or the multi-group activator.

16. The gaming device of claim 10, wherein a probability of selecting one of the element groups is inversely proportional to the outcomes associated with the elements of said element group.

17. The gaming device of claim 10, wherein a probability of activating one of the elements is inversely proportional to the outcome associated with said element.

18. The gaming device of claim 10, wherein when executed by the at least one processor, the plurality of instructions cause the at least one processor to provide an award to the player, wherein said award is based on the number of activations of said element groups.

19. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) cause an element group generator to generate one of a plurality of element groups, wherein each of said element groups include a plurality of elements, a plurality of said elements are in at least two different element groups and at least one element is in only one of said element groups;

(b) activate each of the elements in the generated element group;

(c) determine if any of the elements are activated a predetermined number of times, wherein said predetermined number of times is at least two;

(d) provide a player any outcomes associated with any elements activated the predetermined number of times; and (e) repeat steps (a) to (d) until at least one element is activated the predetermined number of times.

20. The gaming device of claim 19, which includes a multi-group activator associated with a plurality of different element groups, wherein if said multi-group activator is generated, each of the elements in said different element groups associated with said multi-group activator are activated.

21. The gaming device of claim 19, wherein when executed by the at least one processor, the plurality of instructions cause the at least one processor to repeat steps (a) to (d) until a plurality of elements are activated the predetermined number of times.

22. The gaming device of claim 19, wherein when executed by the at least one processor, the plurality of instructions cause the at least one processor to repeat steps (a) to (d) until each of said elements are activated the predetermined number of times.

23. The gaming device of claim 19, wherein a terminating event occurs after a predetermined number of selections of one of the plurality of element groups.

24. The gaming device of claim 19, wherein when executed by the at least one processor, the plurality of instructions cause the at least one processor to provide an award to the player, wherein said award is based on the number of activations of said element groups.

25. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) select and display one of a plurality of element groups or a multi-group activator, wherein a plurality of said element groups each include a plurality of elements, a plurality of elements are in one of said element groups and at least one of said elements is in at least two different element groups and the multi-group activator is associated each of the elements in a plurality of said element groups;

(b) if one of said element groups is selected and displayed, activate each of the elements in the selected element group;

(c) if said multi-group activator is selected and displayed, activate each of the elements in the different element groups associated with said multi-group activator, wherein said activation of each of the elements in the plurality of different element groups associated with the multi-group activator occurs regardless of any previous activation of any of said elements;

(d) determine if any of the elements are activated a predetermined number of times, wherein said predetermined number of times is at least two;

(e) provide a player an outcome based on any of said elements which are activated the predetermined number of times; and (f) repeat steps (a) to (e) until at least one element is activated the predetermined number of times, wherein if one of the element groups is selected and displayed a plurality of times, each of the elements in said element group are activated said plurality of times.

26. The gaming device of claim 25, wherein the multi-group activator is associated with each of said element groups.

27. The gaming device of claim 25, wherein when executed by the at least one processor, the plurality of instructions cause the at least one processor to repeat steps (a) to (e) until a plurality of elements are activated the predetermined number of times.

28. The gaming device of claim 25, wherein when executed by the at least one processor, the plurality of instructions cause the at least one processor to repeat steps (a) to (e) until each of said elements are activated the predetermined number of times.

29. The gaming device of claim 25, wherein a terminating event occurs after a predetermined number of selections of one of the plurality of element groups or the multi-group activator.

30. The gaming device of claim 25, wherein when executed by the at least one processor, the plurality of instructions cause the at least one processor to provide an award to the player, wherein said award is based on the number of activations of said element groups.

31. A method of operating a gaming device including a plurality of instructions, said method comprising:

(a) causing at least one processer to execute the plurality of instructions to generate one of a plurality of element groups or a multi-group activator, wherein a plurality of said element groups each include a plurality of elements, said plurality of elements are associated with a plurality of awards and each of said elements is in at least two different element groups and the multi-group activator is associated with each of the elements in a plurality of said element groups;

(b) causing at least one display device to display the generated element group or the generated multi-group activator;

(c) if one of said element groups is generated and displayed, causing the at least one processer to execute the plurality of instructions to activate each of the elements in the generated element group;

(d) if said multi-group activator is generated and displayed, causing the at least one processer to execute the plurality of instructions to activate each of the elements in a plurality of different element groups associated with the multi-group activator, wherein said activation of each of the elements in the plurality of different element groups associated with the multi-group activator occurs regardless of any previous activation of any of said elements;

(e) causing at least one processer to execute the plurality of instructions to determine if any of the elements are activated a predetermined number of times, wherein said predetermined number of times is at least two;

(f) providing a player any awards associated with the elements activated the predetermined number of times; and (g) causing at least one processer to execute the plurality of instructions to repeating steps (a) to (f) until at least one element is activated the predetermined number of times, wherein if one of the element groups is generated and displayed a plurality of times, each of the elements in said element group are activated said plurality of times.

32. The method of claim 31, wherein steps (a) to (f) are repeated until a plurality of elements are activated the predetermined number of times.

33. The method of claim 31, wherein steps (a) to (f) are repeated until each of the elements are activated the predetermined number of times.

34. The method of claim 31, wherein if the multi-group activator is selected, each of the elements in each of the element groups is activated.

35. The method of claim 31, wherein a terminating event occurs after a predetermined number of generations of one of the plurality of element groups or the multi-group activator.

36. The method of claim 31, which includes operating the gaming device through a data network.

37. The method of claim 36, wherein the data network is an internet.

38. A method for operating a gaming device including plurality of instructions, said method comprising:

(a) causing at least one processer to execute the plurality of instructions to select one of a plurality of element groups or a multi-group activator, wherein a plurality of said element groups each include a plurality of elements, said plurality of elements are associated with a plurality of outcomes and each of said elements is in at least two different element groups and the multi-group activator is associated with each of the elements in a plurality of said element groups;

(b) causing at least one display device to display the selected element group or the selected multi-group activator;

(c) if one of said element groups is selected and displayed, causing the at least one processor to execute the plurality of instructions to activate each of the elements in the selected element group;

(d) if said multi-group activator is selected and displayed, causing the at least one processer to execute the plurality of instructions to activate each of the elements in a plurality of different element groups associated with the multi-group activator, wherein said activation of each of the elements in the plurality of different element groups associated with the multi-group activator occurs regardless of any previous activation of any of said elements;

(e) causing the at least one processer to execute the plurality of instructions to determine if any of the elements are activated a predetermined number of times, wherein said predetermined number of times is at least two;

(f) providing a player the outcome associated with any elements activated the predetermined number of times; and (g) causing the at least one processer to execute the plurality of instructions to repeat steps (a) to (f) until at least one element is activated the predetermined number of times, wherein if one of the element groups is selected and displayed a plurality of times, each of the elements in said element group are activated said plurality of times.

39. The method of claim 38, wherein if the multi-group activator is selected, each of the elements in each of the element groups is activated.

40. The method of claim 38, wherein steps (a) to (f) are repeated until a plurality of elements are activated the predetermined number of times.

41. The method of claim 38, wherein steps (a) to (f) are repeated until each of the elements are activated the predetermined number of times.

42. The method of claim 38, wherein a terminating event occurs after a predetermined number of selections of one of the plurality of element groups or the multi-group activator.

43. The method of claim 38, which includes providing an award to the player, wherein said award is based on the number of activations of said element groups.

44. The method of claim 38, which includes operating the gaming device through a data network.

45. The method of claim 44, wherein the data network is an internet.

46. A method of operating a gaming device including a plurality of instructions, said method comprising:

(a) causing at least one processer to execute the plurality of instructions to generate one of a plurality of element groups, wherein each element group includes a plurality of elements, said plurality of elements are associated with a plurality of outcomes, a plurality of said elements are in at least two different element groups and at least one element is in only one of said element groups;

(b) causing the at least one processer to execute the plurality of instructions to activate each of the elements in the generated element group;

(c) causing the at least one processer to execute the plurality of instructions to determine if any of the elements are activated a predetermined number of times, wherein said predetermined number of times is at least two;

(d) providing a player any outcomes associated with the elements activated the predetermined number of times; and (e) causing the at least one processer to execute the plurality of instructions to repeat steps (a) to (d) until at least one element is activated the predetermined number of times.

47. The method of claim 46, wherein steps (a) to (d) are repeated until a plurality of elements are activated the predetermined number of times.

48. The method of claim 46, wherein steps (a) to (d) are repeated until each of the elements are activated the predetermined number of times.

49. The method of claim 46, which includes a multi-group activator associated with a plurality of different element groups, wherein if said multi-group activator is generated, each of the elements in said different element groups associated with said multi-group activator are activated.

50. The method of claim 46, wherein a terminating event occurs after a predetermined number of generations of one of the plurality of element groups or the multi-group activator.

51. The method of claim 46, which includes providing an award to the player, wherein said award is based on the number of activations of said element groups.

52. The method of claim 46, which includes operating the gaming device through a data network.

53. The method of claim 52, wherein the data network is an internet.

54. A method for operating a gaming device including a plurality of instructions, said method comprising:

(a) causing at least one processer to execute the plurality of instructions to select one of a plurality of element groups or a multi-group activator, wherein a plurality of said element groups each include a plurality of elements, said plurality of elements are associated with a plurality of outcomes, a plurality of elements are in one of said element groups and at least one of said elements is in at least two different element groups and the multi-group activator is associated with each of the elements in a plurality of said element groups;

(b) causing at least one display device to display the selected element group or the selected multi-group activator;

(c) if one of said element groups is selected and displayed, causing the at least one processer to execute the plurality of instructions to activate each of the elements in the selected element group;

(d) if said multi-group activator is selected and displayed, causing the at least one processer to execute the plurality of instructions to activate each of the elements in a plurality of different element groups associated with the multi-group activator, wherein said activation of each of the elements in the plurality of different element groups associated with the multi-group activator occurs regardless of any previous activation of any of said elements;

(e) causing the at least one processer to execute the plurality of instructions to determine if any of the elements are activated a predetermined number of times, wherein said predetermined number of times is at least two;

(f) providing a player the outcome associated with any elements activated the predetermined number of times; and (g) causing at least one processer to execute the plurality of instructions to repeat steps (a) to (f) until at least one element is activated the predetermined number of times, wherein if one of the element groups is selected and displayed a plurality of times, each of the elements in said element group are activated said plurality of times.

55. The method of claim 54, wherein if the multi-group activator is selected, each of the elements in each of the element groups is activated.

56. The method of claim 54, wherein steps (a) to (f) are repeated until a plurality of elements are activated the predetermined number of times.

57. The method of claim 54, wherein steps (a) to (f) are repeated until each of the elements are activated the predetermined number of times.

58. The method of claim 54, wherein a terminating event occurs after a predetermined number of selections of one of the plurality of element groups or the multi-group activator.

59. The method of claim 54, which includes providing an award to the player, wherein said award is based on the number of activations of said element groups.

60. The method of claim 54, which includes operating the gaming device through a data network.

61. The method of claim 60, wherein the data network is an internet.

* * * * *